US009397438B2

(12) United States Patent
Chen

(10) Patent No.: US 9,397,438 B2
(45) Date of Patent: Jul. 19, 2016

(54) ELECTRICAL CONNECTOR HAVING AN OVER-MOLDED SEALING MEMBER

(71) Applicant: FOXCONN INTERCONNECT TECHNOLOGY LIMITED, Grand Cayman (KY)

(72) Inventor: De-Jin Chen, ShenZhen (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/801,745

(22) Filed: Jul. 16, 2015

(65) Prior Publication Data

US 2016/0020549 A1 Jan. 21, 2016

(30) Foreign Application Priority Data

Jul. 16, 2014 (CN) ..... 2014 2 0391083 U

(51) Int. Cl.

| | |
|---|---|
| ***H01R 13/40*** | (2006.01) |
| ***H01R 13/52*** | (2006.01) |
| *H01R 12/72* | (2011.01) |
| *H01R 24/62* | (2011.01) |
| *H01R 43/00* | (2006.01) |

(52) U.S. Cl.

CPC ..... *H01R 13/5219* (2013.01); *H01R 13/5202* (2013.01); *H01R 12/724* (2013.01); *H01R 13/5216* (2013.01); *H01R 24/62* (2013.01); *H01R 43/005* (2013.01)

(58) Field of Classification Search

CPC ..... H01R 13/52; H01R 13/5202; H01R 13/5205; H01R 13/521; H01R 13/6581

USPC ..... 439/271–275, 587–589

See application file for complete search history.

(56) References Cited

U.S. PATENT DOCUMENTS

| | | | | |
|---|---|---|---|---|
| 2014/0120767 | A1* | 5/2014 | Itsuki | H01R 13/5208 439/587 |
| 2014/0148034 | A1* | 5/2014 | Kashiwada | H01R 13/512 439/345 |
| 2014/0148045 | A1* | 5/2014 | Kashiwada | H01R 23/7073 439/485 |
| 2014/0308833 | A1* | 10/2014 | Fukami | B29C 70/72 439/271 |
| 2015/0155661 | A1* | 6/2015 | Chen | H01R 13/6594 439/607.01 |
| 2015/0303627 | A1* | 10/2015 | Naito | H01R 13/701 439/607.27 |
| 2015/0333435 | A1* | 11/2015 | Arai | H01R 12/716 439/589 |

FOREIGN PATENT DOCUMENTS

| | | |
|---|---|---|
| CN | 201690049 | 12/2010 |

* cited by examiner

*Primary Examiner* — Chandrika Prasad

(74) *Attorney, Agent, or Firm* — Wei Te Chung; Ming Chieh Chang

(57) ABSTRACT

An electrical connector includes a terminal module, a first sealing member embodied in a rear portion of the terminal module and a metallic shell shielding around the terminal module and the first sealing member. The terminal module has an insulative housing and a plurality of conductive terminals received in the housing. Each of the conductive terminals has a connecting section extending outwardly from a rear end of the housing. The first sealing member is insert molded on the housing of the terminal module, and the connecting sections of the conductive terminals rearwards run through the first sealing member.

20 Claims, 7 Drawing Sheets

ELECTRICAL CONNECTOR HAVING AN OVER-MOLDED SEALING MEMBER

BACKGROUND OF THE INVENTION

1. Field of the Invention

The present invention generally relates to an electrical connector, and more particularly to an electrical connector having waterproof structure.

2. Description of Related Art

Chinese patent issued NO. 201690049 discloses an electrical connector having waterproof function, the electrical connector comprises an insulative housing, a plurality of conductive terminals received in the insulative housing, a metallic shell shielding around the insulative housing and a sealing ring retained to the insulative housing. The insulative housing has a base portion and a mating portion extending forwardly from the base portion. The base portion defines a ring-like slot recessed from an outer surface thereof. The sealing ring is received in the slot and abuts against an inner surface of the metallic shell for waterproof Each of the conductive terminals has a contacting section exposed on the mating portion and a connecting section extending out of the base portion of the insulative housing. The sealing ring is just fit for the normal waterproof electrical connector. A new waterproof structure is needed to be created for electronic products having higher requirement in waterproof grade such as IPX5, IPX6, IPX7 and IPX8.

Therefore, an electrical connector having new waterproof structure is provided to overcome the drawbacks described aforementioned would be desirable.

SUMMARY OF THE INVENTION

Accordingly, an object of the present invention is to provide an electrical connector having waterproof structure.

In order to achieve the object set forth, an electrical connector comprises a terminal module, a first sealing member embodied in a rear portion of the terminal module and a metallic shell shielding around the terminal module and the first sealing member. The terminal module has an insulative housing and a plurality of conductive terminals received in the housing. Each of the conductive terminals has a connecting section extending outwardly from a rear end of the housing. The first sealing member is insert molded on the housing of the terminal module, and the connecting sections of the conductive terminals rearwards run through the first sealing member.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
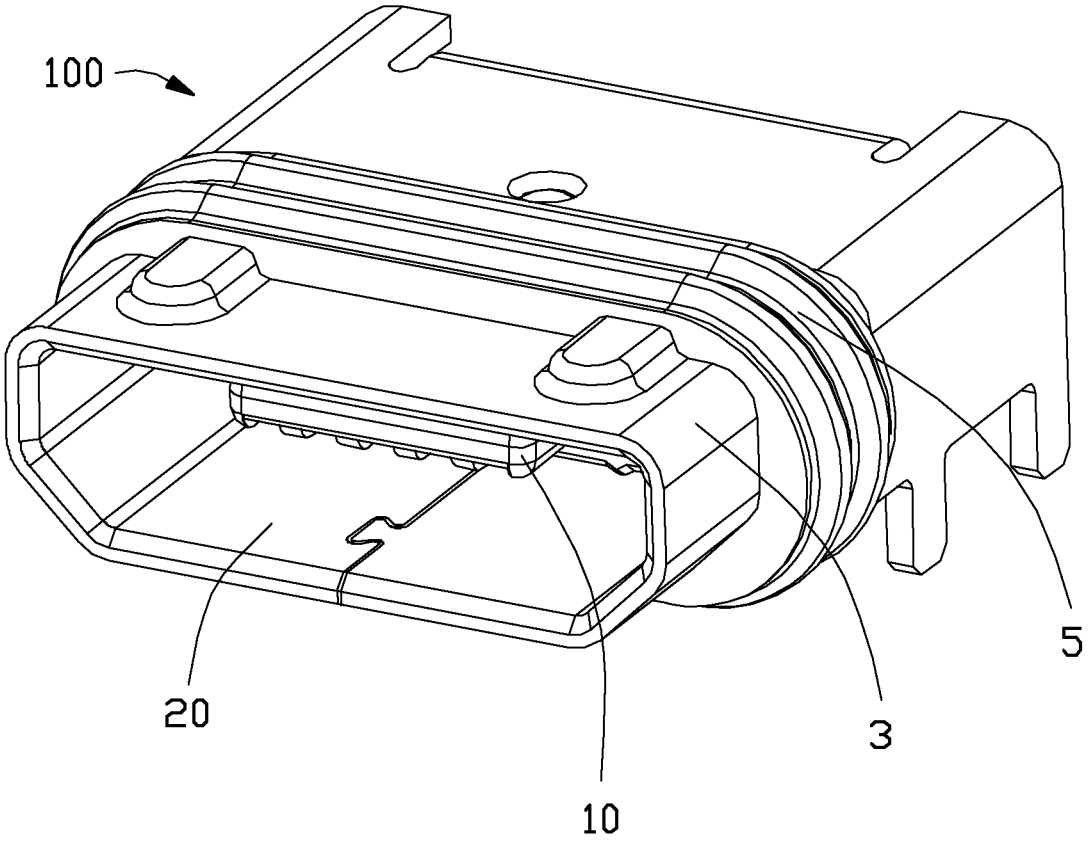
FIG. 1 is a perspective view of an electrical connector of the present invention.
Figure 2:
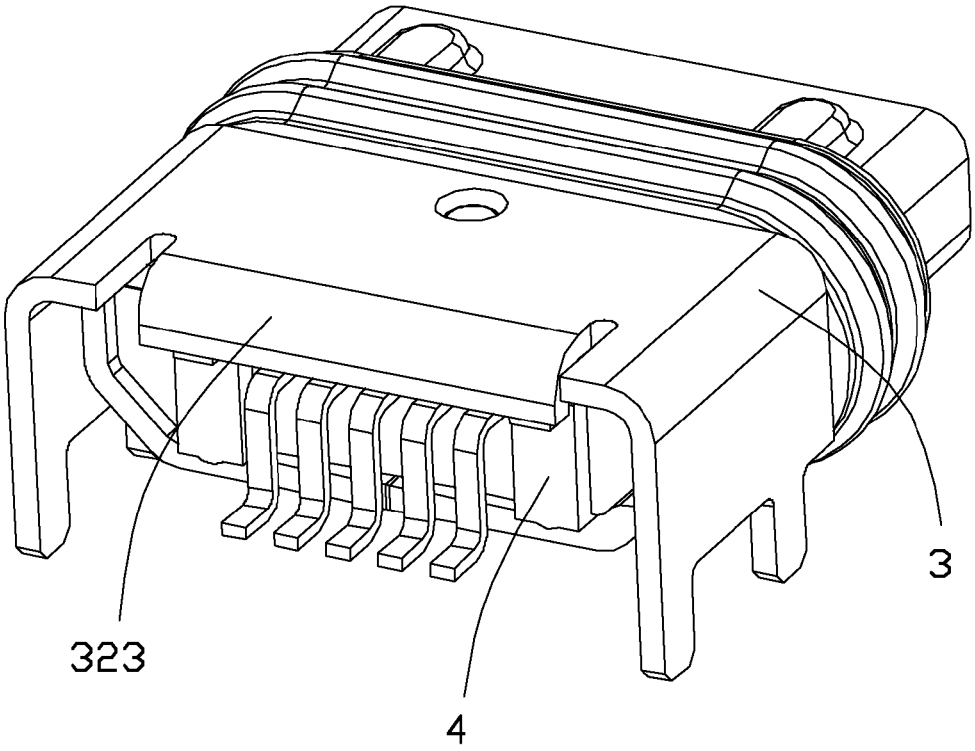
FIG. 2 is another perspective view of the electrical connector shown in FIG. 1.

Referring to FIG. 1 and FIG. 2, the present invention provides with an electrical connector 100 having waterproof function. The waterproof performance of the electrical connector 100 can obtain at least a level of IPX5 which is superior to the ordinary waterproof electrical connector. The electrical connector 100 has a terminal module 10, a first sealing member 4 covering a rear portion of the terminal module 10 and a metallic shell 3 shielding around the terminal module 10 and the first sealing member 4. The first sealing member 4 may be made of rubber or other elastic material with excellent waterproof performance The metallic shell 3 surrounds the terminal module 10 to form a mating cavity 20 opening forwardly. The first sealing member 4 is insert molded on the rear portion of the terminal module 10 for preventing liquid material such as water from flowing into electronic product via joint of the metallic shell 3 and the terminal module 10. The electrical connector 100 further comprises a second sealing member 5 disposed around an outer surface of the metallic shell 3 for stopping the liquid material such as water from flowing into interior of electronic product via joint of the metallic shell 3 and the electronic product. The second sealing member 5 is insert molded on the outer surface of the metallic shell 3 in the present invention and may be made of rubber or other elastic material with excellent waterproof performance.

Figure 3:
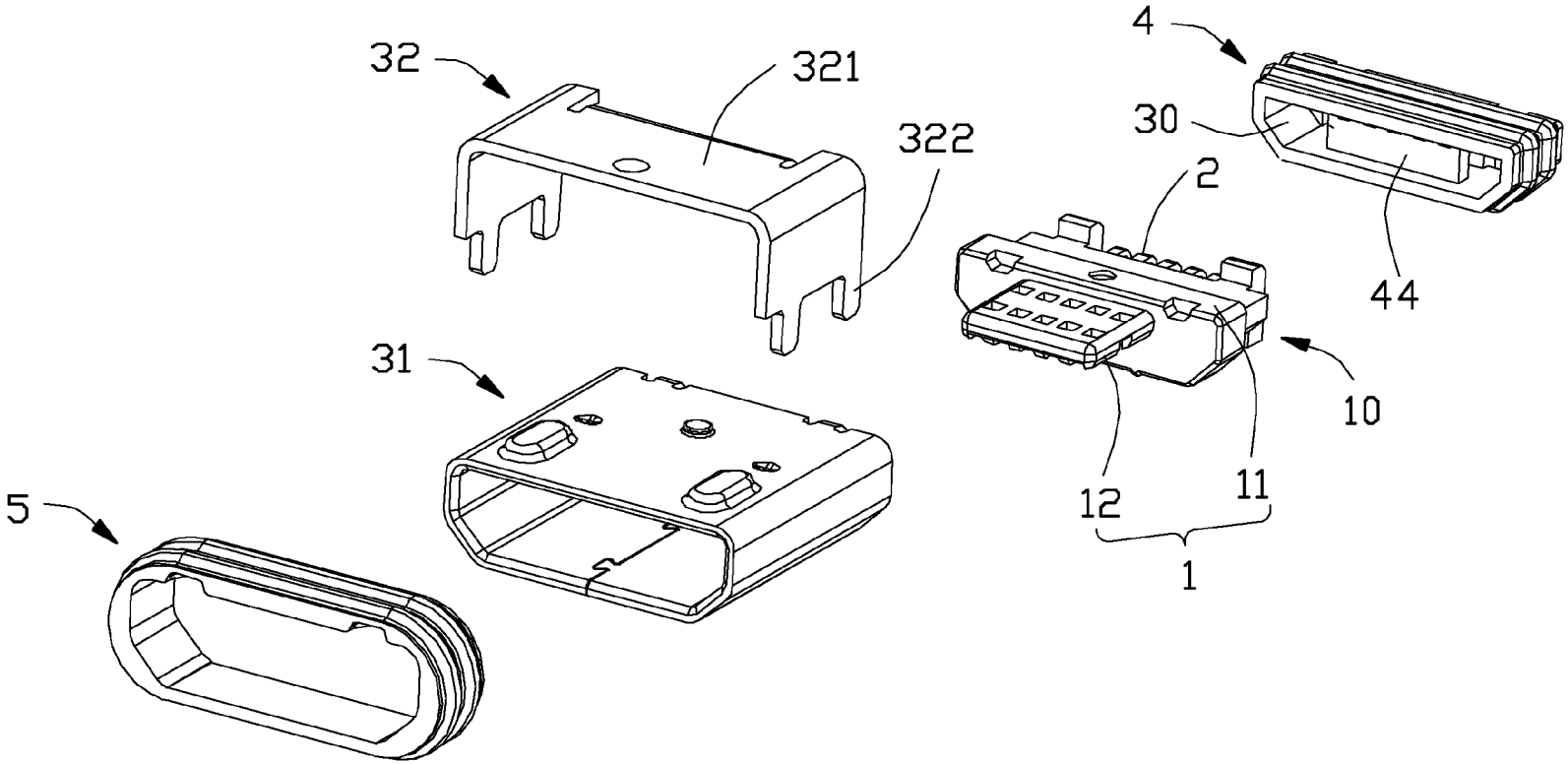
FIG. 3 is an exploded perspective view of the electrical connector shown in FIG. 1.
Figure 4:
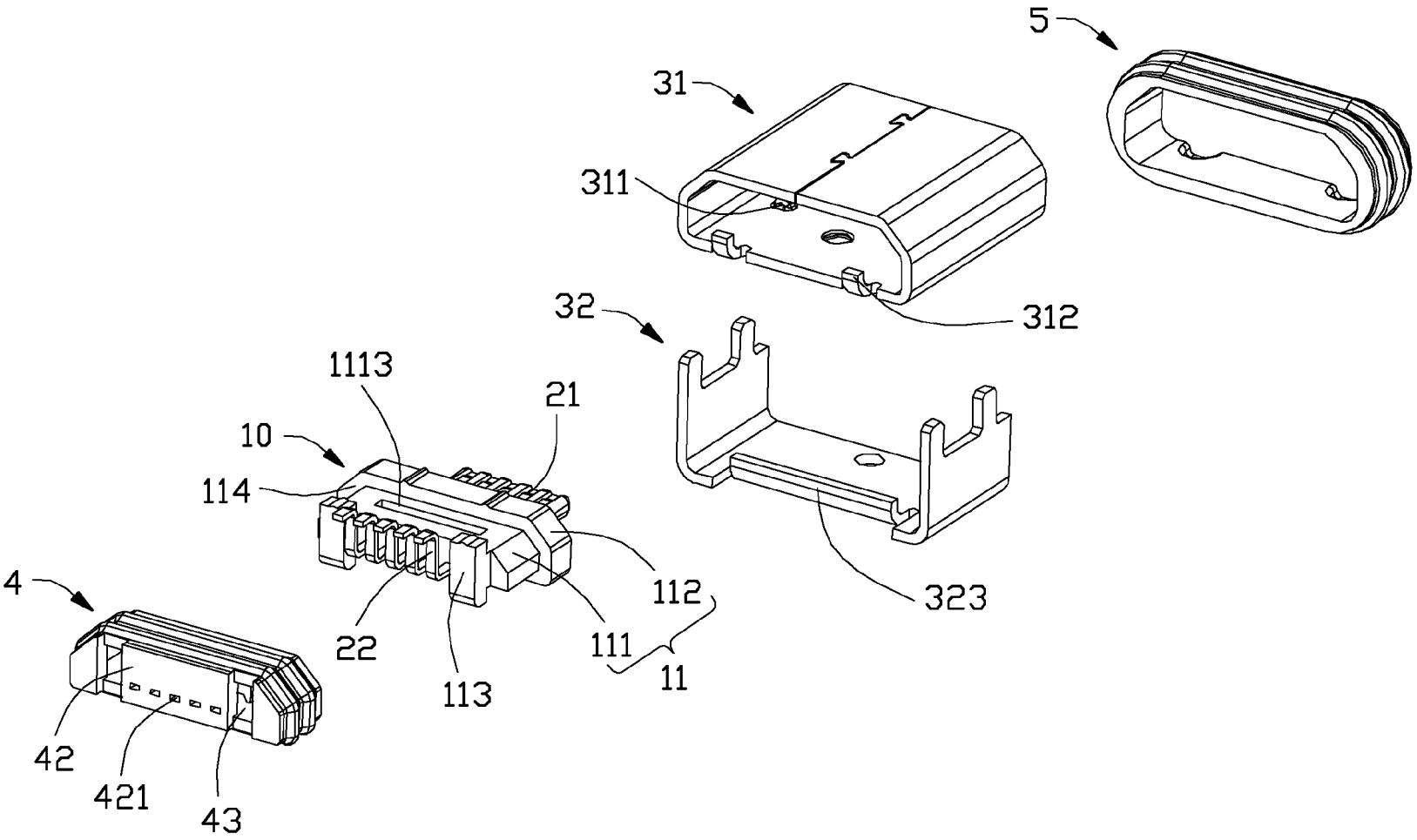
FIG. 4 is another exploded perspective view of the electrical connector shown in FIG. 1.
Figure 5:
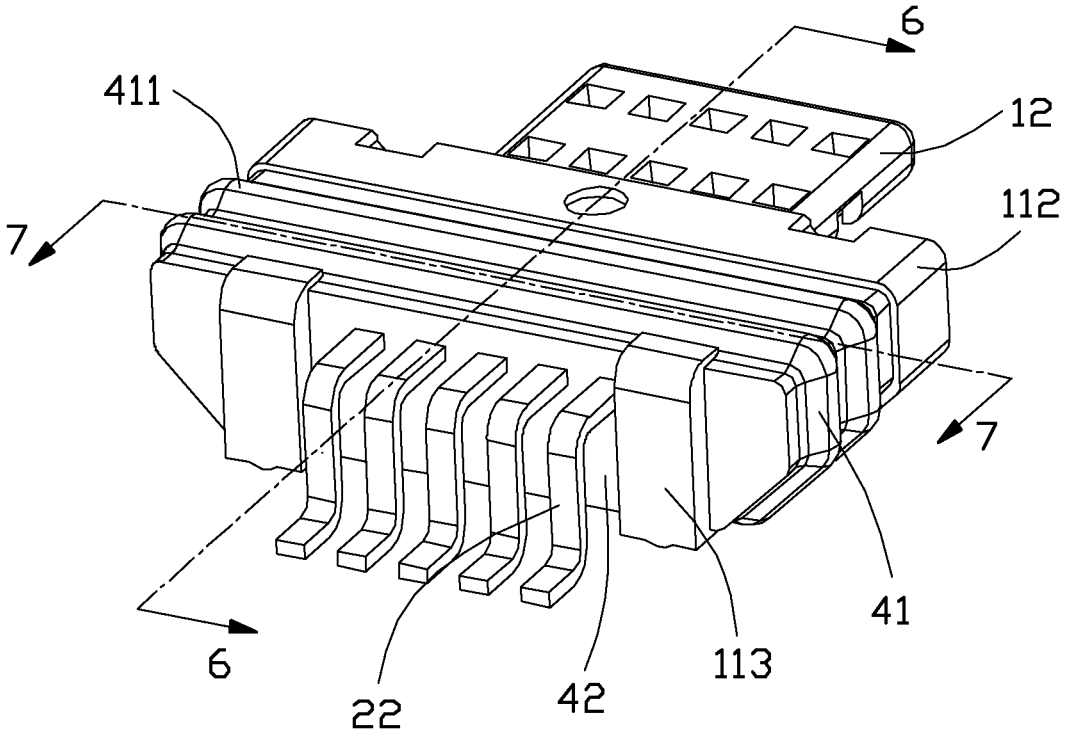
FIG. 5 is a perspective view of the terminal module inserted with a sealing member on the rear portion thereof shown in FIG. 3.
Figure 6:
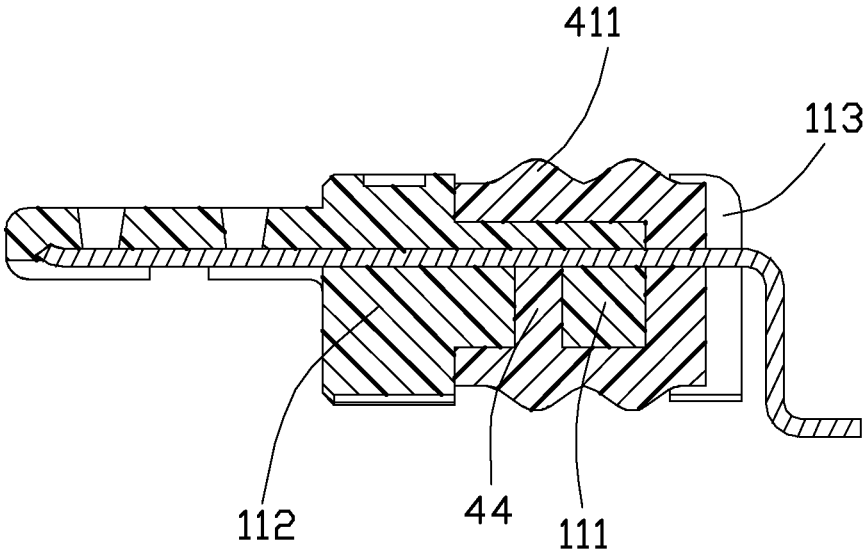
FIG. 6 is a sectional view of the electrical connector along line 6-6 shown in FIG. 5.

Referring to FIG. 3 and FIG. 4, the terminal module 10 comprises an insulative housing 1 and a plurality of conductive terminals 2 received in the insulative housing. The insulative housing 1 has a base portion 11 and a mating portion 12 extending forwardly from the base portion 11. The conductive terminals 2 have contacting sections 21 exposed on the mating portion 12 and connecting sections 22 extending outwardly from a rear end of the insulative housing 1. Referring to FIG. 5 and FIG. 6, the first sealing member 4 is insert molded on the insulative housing 1 of the terminal module 10 and sealing around each of the connecting sections 22 of the conductive terminals 2 for improving waterproof level. It means that each of the connecting sections 22 extends rearwardly and outwardly through the first sealing member 4. The first sealing member 4 has a sealing ring 41 sealing around an outer surface of the insulative housing 1 and a sealing wall 42 sealing a rear end of the insulative housing 1. Each of the connecting sections 22 of the conductive terminals 2 extends outwardly from the sealing wall 42. The sealing ring 41 has a plurality of continuous protruding portions 411 on an outer surface thereof for interfering with an inner surface of the metallic shell 3 which is benefit for fixing the two elements 41, 3. The insulative housing 1 has two stopping blocks 113 disposed at two sides of the connecting sections 22 and extend rearwards relative to the base portion 11 thereof. The stopping block 113 is partly embedded in a rear portion of the sealing ring 41 to provide a steadily retention between the terminal module 10 and the first sealing member 4 and further to stop the sealing member 4 rearwardly moving when assembling the terminal module 10 into the metallic shell 3.

Figure 7:
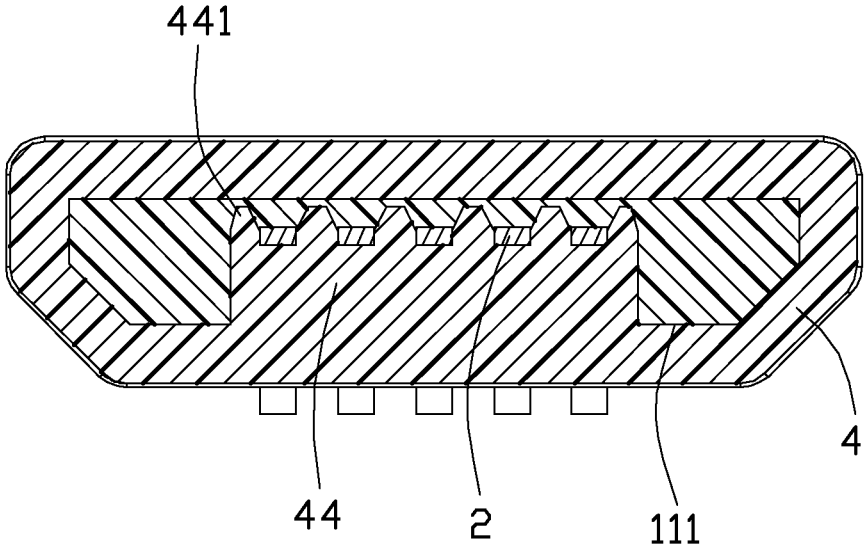
FIG. 7 is a sectional view of the electrical connector along line 7-7 shown in FIG. 1.

In the present invention, FIG. 3 and FIG. 4 show an exploded perspective view in condition that the sealing member 4 is peeled from the terminal module 10. The sealing ring 41 and the sealing wall 42 surround to form an accommodating room 30. The sealing wall 42 is formed with a plurality of fixing holes 421 corresponding to the connecting sections 22 of the conductive terminals 2. The sealing member 4 is formed with two receiving rooms 43 at two sides of the fixing holes 421 after the elastic material insert molded on the insulative housing 1. Each of the receiving rooms 43 runs through the sealing wall 42 in a front-to-back direction. The two receiving rooms 43 have a same structure and runs through an upper surface and a lower surface of the sealing member 4. What's more, the base portion 11 of the insulative housing 1 has a first base portion 111 accommodated in the accommodating room 30 and a second base portion 112 disposed in front of the sealing ring 41. The sealing ring 41 is mostly disposed between the stopping blocks 113 and the second base portion 112. An outer surface of the first base portion 111 is recessed relative to outer surfaces of the stopping blocks 113 and the second base portion 112 to form a continuous trough. The first base portion 111 and the second base portion 112 may be formed in one insert-molding process. In other embodiments, the first base portion 111 may be formed by cutting a part of the rear portion of the insulative housing 1. After the insulative housing is formed, the sealing material is injected onto the first base portion 111 to form the first sealing member 4 aforementioned. The first sealing member 4 is finally formed after the sealing material cooling and disposed adjacent to the second base portion 112, thereby a stepping face 114 is formed between the first base portion 111 and the second base portion 112 to connect with the two base portions 111, 112. The first sealing member 4 is located behind the stepping face 114, a front face of the sealing ring 41 abuts against the stepping face 114. The first base portion 111 has a pouring hole 1113 in which the connecting sections 22 of the conductive terminals 2 are exposed. Combined with FIG. 6, the sealing material is poured into the pouring hole 1113 to sealing the connecting sections 22. The sealing member 4 is formed with an extending portion 44 extending into the pouring hole 1113 from an inner surface of the sealing ring 41. In the present embodiment, the conductive terminals 2 are insert molded in the insulative housing 1. The pouring hole 1113 is formed after a mold pulled out. In other embodiments, the pouring hole 1113 may be specifically made. Referring to FIG. 7, the extending portion 44 defines a plurality of protruding portions 441 corresponding to the conductive terminals 2 The protruding portions 441 and the conductive terminals 2 are disposed at an interval manner along a transverse direction perpendicular to the front-to-back direction. The extending portion 44 has a notch between every two protruding portions 441, and a corresponding connecting section 22 is disposed in the notch. In fact the sealing material will flow in to the gap between the conductive terminals and the first base portion 111.

The metallic shell 3 has a receiving room with a front opening and a rear opening. The terminal module 10 embodied with the first sealing member 4 is assembled into the metallic shell 3 from the rear opening of the metallic shell. At least a part of the sealing ring 41 is disposed in the interior of the metallic shell 3 to interfere with the metallic shell 3. The metallic shell 3 comprises a first shell 31 surrounding the insulative housing 1 and a second shell 32 secured to the first shell 31 and fixing electrical connector 100 onto a printed circuit board (not labeled). The first shell 31 is insert molded with the second sealing member 5. The second sealing member 5 is disposed behind a front side edge of the first shell 31 and in front of a front face of the second shell 32. In the present embodiment, The first shell 31 surrounds the terminal module 10 and the first sealing member 4. The protruding portions 411 of the sealing ring 41 are disposed to interfere with the first shell 31. The second shell 32 is disposed as a bracket and comprises a flat body portion 321 retained to the first shell 31 and several soldering legs 321 disposed at two sides of the first shell 31. The metallic shell 3 has at least a first stopping portion 311 used for preventing the terminal module 10 forwardly moving and two second stopping portions 312 abutting against a rear face of the stopping blocks 113, thereby the terminal module 10 is fixed in the metallic shell 3. Combined with FIG. 2, the second shell 32 has a third stopping portion 323 disposed behind the first sealing member 4, and the second stopping portion 312 is located between the stopping block 113 and the third stopping portion 323. In the present embodiment, the first sealing member 4 is made as one element to seal gaps between the housing 1, the connecting sections 22 of the conductive terminals 2 and the metallic shell 3.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

I claim:

1. An electrical connector comprising:

a terminal module having an insulative housing and a plurality of conductive terminals received in the housing and extending along a front-to-back direction, each of the conductive terminals having a connecting section extending outwardly from a rear end of the housing; and a first sealing member embodied upon a rear portion of the terminal module; and a metallic shell shielding around the terminal module and the first sealing member; wherein the first sealing member is over-molded upon the housing of the terminal module, and is circumferentially interferential compressed and deformed in and by the metallic shell in an interferential manner so as to prevent humidity invasion along the front-to-back direction in said metallic shell.

2. The electrical connector as claimed in claim 1, wherein the first sealing includes a sealing wall behind the rear end of the housing and the connecting sections of the conductive terminals rearwards snugly run through said sealing wall.

3. The electrical connector as claimed in claim 2, wherein the first sealing member comprises a sealing ring circumferentially surrounding the housing and is compressible in a vertical plane perpendicular to said front-to-back direction to resulting in said interferential manner.

4. The electrical connector as claimed in claim 3, wherein the housing has at least a stopping block embedded in a rear portion of the sealing member for preventing the first sealing member moving rearwards.

5. The electrical connector as claimed in claim 4, wherein the stopping block protrude rearwards out of a rear face of the first sealing member.

6. The electrical connector as claimed in claim 5, wherein the housing has a base portion, the metallic shell has at least a first stopping portion rearwards abutting against the base portion and at least a second stopping portion disposed behind the base portion and forwardly abutting against the stopping block.

7. The electrical connector as claimed in claim 4, wherein the sealing ring and the sealing wall surround to form an accommodating room, the housing has a first base portion accommodated in the accommodating room and a second base portion disposed in front of the first base portion, the sealing ring is disposed between the stopping block and the second base portion.

8. The electrical connector as claimed in claim 7, wherein an outer surface of the first base portion is recessed relative to an outer surface of the stopping block and the second base portion to form a ring-like continuous slot.

9. The electrical connector as claimed in claim 8, wherein the first base portion has an extending hole recess from an outer surface thereof, and the first sealing member has an extending portion extending into the extending hole from an inner surface of the sealing ring.

10. The electrical connector as claimed in claim 9, wherein the extending portion has a plurality of protruding portions corresponding to the conductive terminals, each of the conductive terminals is disposed in a notch between every two protruding portions.

11. The electrical connector as claimed in claim 6, wherein the metallic shell has a first shell and a second shell secured to the first shell, the first shell defines the second stopping portion, the second shell has at least a third stopping portion disposed behind the first sealing member, the second stopping portion is disposed between the stopping block and the third stopping portion.

12. The electrical connector as claimed in claim 1, further comprising a second sealing member insert molded onto an outer surface of the metallic shell, the metallic shell has a first shell and second shell fixing the electrical connector to a printed circuit board, the second sealing member is disposed on the first shell and in front of the second shell.

13. A method of assembling an electrical connector, comprising steps of:

providing a terminal module having an insulative housing and a plurality of conductive terminals insert-molded within the housing by a first molding process, and extending along a front-to-back direction, each of the conductive terminals having a connecting section extending outwardly from the terminal module;

providing a sealing member over-molded on the terminal module by a second molding process;

providing a metallic shell having an accommodating space with a front opening and a rear opening; and inserting the terminal module and the associated sealing member into the accommodating space from the rear opening in a rear-to-front direction; wherein said sealing member is circumferentially compressed and deformed by and in the metallic shell in an interferential manner to prevent humidity invasion along said front-to-back direction in said metallic shell.

14. The method as claimed in claim 13, wherein said sealing member circumferentially surrounds the housing with a ring structure which is compressible in a vertical plane perpendicular to said front-to-back direction to result in said interferential manner.

15. The method as claimed in claim 13, wherein said sealing member further includes a wall structure behind the housing through which the connection sections of the terminals extend rearwardly.

16. The method as claimed in claim 13, wherein the housing defines, in the first molding process, a plurality of pouring holes respectively communicating and aligned with the corresponding terminals in a vertical direction perpendicular to said front-to-back direction, and the sealing member fills up said pouring holes in the second molding process.

17. An electrical connector comprising:

a terminal module including an insulative housing with a plurality of terminals embedded therein, each of said terminals extending along a front-to-back direction with a front mating section and rear connecting section exposed rearwardly outside of the housing;

a sealing member circumferentially over-molded upon the housing; and a metallic shell enclosing the associated terminal module and sealing member; wherein the sealing member is circumferentially compressed and deformed between the shell and the housing in an interferential manner to prevent humidity invasion along the front-to-back direction in said shell.

18. The electrical connector as claimed in claim 17, wherein the sealing member further includes a sealing wall to cover a rear side of the housing along the front-to-back direction, and the rear connecting sections extend through said sealing wall.

19. The electrical connector as claimed in claim 17, wherein the housing forms a plurality of pouring holes respectively communicating and aligned with the corresponding terminals in a vertical direction perpendicular to said front-to-back direction, and the sealing member fills said pouring holes.

20. The electrical connector as claimed in claim 17, wherein each of said terminals includes a portion simultaneously sandwiched between the housing and the sealing member in a vertical direction perpendicular to said front-to-back direction.

* * * * *